US011783973B2

(12) United States Patent
Kitaoka et al.

(10) Patent No.: US 11,783,973 B2
(45) Date of Patent: Oct. 10, 2023

(54) R-T-B BASED PERMANENT MAGNET

(71) Applicant: TDK CORPORATION, Tokyo (JP)

(72) Inventors: Hidetake Kitaoka, Tokyo (JP); Makoto Iwasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 27 days.

(21) Appl. No.: 16/291,950

(22) Filed: Mar. 4, 2019

(65) Prior Publication Data

US 2019/0295752 A1 Sep. 26, 2019

(30) Foreign Application Priority Data

Mar. 22, 2018 (JP) ..... 2018-055283

(51) Int. Cl.

| | |
|---|---|
| ***H01F 1/057*** | (2006.01) |
| ***C22C 38/16*** | (2006.01) |
| ***C22C 38/10*** | (2006.01) |
| ***C22C 38/06*** | (2006.01) |
| ***C22C 38/00*** | (2006.01) |

(Continued)

(52) U.S. Cl.

CPC ..... *H01F 1/0577* (2013.01); *C22C 38/001* (2013.01); *C22C 38/002* (2013.01); *C22C 38/005* (2013.01); *C22C 38/06* (2013.01); *C22C 38/10* (2013.01); *C22C 38/16* (2013.01); *B22F 3/10* (2013.01); *B22F 9/04* (2013.01); *B22F 2009/044* (2013.01); *B22F 2301/355* (2013.01); *C22C 2202/02* (2013.01)

(58) Field of Classification Search

CPC ..... H01F 1/0577; C22C 38/16; C22C 38/10; C22C 38/06; C22C 38/005; C22C 38/001; C22C 38/002; C22C 2202/02; B22F 2301/355; B22F 9/04; B22F 2009/044; B22F 3/10; B22F 2999/00; B22F 2998/10

See application file for complete search history.

(56) References Cited

U.S. PATENT DOCUMENTS

| | | | | |
|---|---|---|---|---|
| 10,672,546 | B2 * | 6/2020 | Miwa | C22C 38/10 |
| 2006/0137767 | A1 * | 6/2006 | Yamamoto | C22C 38/10 148/302 |

(Continued)

FOREIGN PATENT DOCUMENTS

| | | | |
|---|---|---|---|
| CN | 105741995 | A * | 7/2016 |
| CN | 105845305 | A | 8/2016 |

(Continued)

*Primary Examiner* — Sally A Merkling
*Assistant Examiner* — Austin Pollock
(74) *Attorney, Agent, or Firm* — Oliff PLC

(57) ABSTRACT

An R-T-B based permanent magnet in which R is a rare earth element, T is Fe or a combination of Fe and Co, B is boron, and further includes M. The R-T-B based permanent magnet includes main phase grains consisting of $R_2T_{14}B$ phase. M at least includes Ga and Zr. The R-T-B based permanent magnet further includes C and O. R content is 29.0 mass % to 33.0 mass %, B content is 0.85 mass % to 1.05 mass %, Ga content is 0.30 mass % to 1.20 mass %, 0 content is 0.03 mass % to 0.20 mass %, and C content is 0.03 mass % to 0.30 mass %. Further, the R-T-B based permanent magnet satisfies $3.48m(B)-2.67 \leq m(Zr) \leq 3.48m(B)-1.87$ in which m(B) (mass %) is B content and m(Zr) (mass %) is Zr content.

20 Claims, 6 Drawing Sheets

(51) Int. Cl.
*B22F 9/04* (2006.01)
*B22F 3/10* (2006.01)

(56) References Cited

U.S. PATENT DOCUMENTS

2007/0144615 A1* 6/2007 Komuro ..... H01F 41/0293 148/105
2014/0132377 A1 5/2014 Nakajima et al.
2015/0155083 A1* 6/2015 Miwa ..... H01F 1/0577 335/302
2015/0235750 A1* 8/2015 Miwa ..... C22C 38/005 335/302
2016/0180993 A1* 6/2016 Kanada ..... C22C 38/002 252/62.55
2016/0189838 A1* 6/2016 Nishiuchi ..... C22C 30/02 148/302
2016/0225501 A1 8/2016 Miwa et al.
2017/0018342 A1* 1/2017 Fukagawa ..... C22C 38/14
2017/0250014 A1 8/2017 Hidaka et al.
2017/0250016 A1 8/2017 Miwa et al.
2018/0182518 A1 6/2018 Satoh et al.
2020/0303099 A1* 9/2020 Fujiwara ..... H01F 1/057

FOREIGN PATENT DOCUMENTS

CN 107134864 A 9/2017
JP 2002075717 A * 3/2002 ..... H01F 1/057
JP 3891307 B2 3/2007
JP 2013-216965 A 10/2013
JP 2014027268 A * 2/2014
JP 2014027628 A * 2/2014
JP 2016086078 A * 5/2016
JP 2017017121 A * 1/2017
JP 6090550 B1 3/2017
JP 2017-157832 A 9/2017

* cited by examiner

R-T-B BASED PERMANENT MAGNET

TECHNICAL FIELD

The present invention relates to an R-T-B based permanent magnet.

BACKGROUND

Patent Document 1 discloses an R-T-B based sintered magnet having a main phase mainly including $R_2Fe_{14}B$ and a grain boundary phase including more R than in the main phase, and the grain boundary phase includes a grain boundary phase with a high rare earth element concentration (a phase with a total atom concentration of a rare earth element R of 70 atom % or more) and a grain boundary phase having a low rare earth element concentration and a high transition metal element concentration (a phase preferably having a total atomic concentration of a rare earth element R of 25 to 35 atom %, and a total atomic concentration of a transition metal element T which includes Fe as essential element of 50 to 70 atom %). Thereby, Patent Document 1 obtains the R-T-B based sintered magnet having a high coercive force without increasing Dy content. Also, Patent Document 1 discloses that the R-T-B based sintered magnet can have the maximum coercive force at a specific B concentration (B content). The specific B concentration (B content) disclosed in Patent Document 1 is lower than B content in a conventional R-T-B based permanent magnet.

Patent Document 2 discloses a Nd—Fe—B based rare earth element sintered magnet capable of suppressing an abnormal grain growth and widening an optimum sintering temperature range by precipitating at least two selected from an M-B based compound, an M-B—Cu based compound, and an M-C based compound (M is at least one selected from Ti, Zr, and Hf) and also precipitating oxides of R in a magnet composition.

Patent Document 3 discloses an R-T-B based sintered magnet in which Ti content is controlled to a specific range to generate borides of Ti, thereby reducing the amount of boron which does not form borides of Ti. Further, Patent Document 3 discloses that by reducing the amount of boron other than borides of Ti, even when a heavy rare earth element content is reduced, the R-T-B based sintered magnet having a high residual magnetic flux density, a high coercive force, and a high Hk/Hcj can be obtained.

[Patent Document 1] JP Patent Application Laid Open No. 2013-216965

[Patent Document 2] JP Patent No. 3891307

[Patent Document 3] JP Patent No. 6090550

SUMMARY

An R-T-B based sintered magnet of Patent Document 1 has a lower squareness ratio than a general R-T-B based permanent magnet. When the squareness ratio is low, it is easily demagnetized, hence an R-T-B based permanent magnet having a high residual magnetic flux density (Br), a high coercive force (Hcj), and also a high squareness ratio is in demand.

Patent document 1 uses Sq as the squareness ratio. Patent document 1 does not disclose a definition of Sq, however considering that a BH curve tracer (Toei Kogyo TPM2-10) is used as a measuring device, Sq is obtained from Sq=(Area of inner region 3 of demagnetization curve 1)/(Ideal area) in the second quadrant of I-H curve shown in FIG. 1. Note that, the ideal area is (Br×Hcj) and it is a sum of an area of outer region 2 and an area of inner region 3 of the demagnetization curve 1.

However, in general, the squareness ratio is shown by Hk/Hcj in many cases. In the second quadrant of I-H curve, Hk is a degree of H when I=0.9Br. Further, Hk/Hcj is a value of which Hk is divided by Hcj. Here, if the demagnetization curve 1 does not have an abnormal inflection point, which is formed when a soft magnetic phase such as an $R_2T_{17}$ phase and the like is formed in the R-T-B based permanent magnet, then it is thought that Sq≥Hk/Hcj is satisfied. Therefore, the evaluation method using Hk/Hcj as an evaluation method of the sqareness ratio is considered to be a strict evaluation method.

Also, the squareness ratio improves as a sintering temperature increases, but if the sintering temperature is too high, an abnormal grain growth occurs and the squareness ratio decreases. Thus, an optimum sintering temperature is a temperature which sufficiently improves the squareness ratio without the abnormal grain growth taking place. From industrial production, it is difficult to make uniform heating temperature in an entire sintering furnace. Therefore, the wider the optimum sintering temperature range (hereinafter, this may be referred as optimum sintering temperature range) is, the higher the production stability is.

When B content is smaller compared to the conventional R-T-B based permanent magnet as in case of the R-T-B based sintered magnet disclosed in Patent Document 1, the above optimum sintering temperature range is narrow and it is difficult to improve Hk/Hcj stably.

When a technique disclosed in Patent Document 2 is applied to a Nd—Fe—B based rare earth sintered magnet disclosed in Patent Document 1 in order to suppress the abnormal grain growth and to attain a wider optimum sintering temperature range, since B content is small, many M-C based compounds are precipitated, and precipitated amounts of M-B based compound and M-B—Cu based compound decrease. Therefore, the Nd—Fe—B based rare earth sintered magnet obtained by applying the technique disclosed in Patent Document 2 to Patent Document 1 does not have sufficient effect to suppress the abnormal grain growth, and the optimum sintering temperature range is not wide enough as well.

Also, a composition similar to that of an R-T-B based sintered magnet disclosed in Patent Document 3 was examined, and was found that the R-T-B based sintered magnet disclosed in Patent Document 3 does not have sufficient effect to suppress the abnormal grain growth, and the optimum sintering temperature range is not wide enough.

On the other hand, when B content of the R-T-B based permanent magnet (B content with respect to the entire permanent magnet) is about 1.0 mass % or more, the abnormal grain growth scarcely occurs and the optimum sintering temperature range can be widened easily, but sufficiently high magnetic properties are difficult to obtain unless large amount of a heavy rare earth element as a rare earth element R is used.

The present invention is attained in view of such circumstances, and the object of the present invention is to provide the R-T-B based permanent magnet having high residual magnetic flux density (Br), coercive force (Hcj), and squareness ratio (Hk/Hcj).

In order to attain the above object, the R-T-B based permanent magnet has C, O, and M, wherein R is a rare earth element, T is Fe or a combination of Fe and Co, and B is boron, M includes at least Ga and Zr, and further includes at least one element selected from Al, Si, P, Ti, Cr, Mn, Ni, Cu, Zn, Ge, Nb, Ag, In, Sn, Sb, Hf, Ta, W, and Bi, R content is 29.0 mass % to 33.0 mass %, B content is 0.85 mass % to 1.05 mass %, Ga content is 0.30 mass % to 1.20 mass %, 0 content is 0.03 mass % to 0.20 mass %, C content is 0.03 mass % to 0.30 mass %, where the R-T-B based permanent magnet is 100 mass %, and the R-T-B based permanent magnet satisfies $$3.48m(\mathrm{B})-2.67 \leq m(\mathrm{Zr}) \leq 3.48m(\mathrm{B})-1.87$$

in which m(B) (mass %) is B content and m(Zr) (mass %) is Zr content.

By having the above characteristic, the present invention attains the R-T-B based permanent magnet having high Br, Hcj, and Hk/Hcj, and having a wide sintering temperature range while without having an abnormal grain growth.

The R-T-B based permanent magnet according to the present invention may satisfy $0.0979m(\mathrm{Zr})-0.44m(\mathrm{B})+0.39 \leq m(\mathrm{C}) \leq 0.0979m(\mathrm{Zr})-0.44m(\mathrm{B})+0.49$ in which m(C) (mass %) is C content.

The R-T-B based permanent magnet according to the present invention may include a Zr—B phase, a Zr—C phase, and an $R_6T_{13}Ga$ phase.

The R-T-B based permanent magnet according to the present invention may have a long side of the Zr—B phase of 300 nm or more and 500 nm or less in average.

The R-T-B based permanent magnet according to the present invention may include an R—O—C—N phase.

The R-T-B based permanent magnet according to the present invention may not substantially include an $R_2T_{17}$ phase.

The R-T-B based permanent magnet according to the present invention may have Br at 23° C. of 1305 mT or more, Hcj of 1432 kA/m or more, and Hk/Hcj of 95% or more.

The R-T-B based permanent magnet according to the present invention may include at least one of Dy, Tb, and Ho as R, and a total content of Dy, Tb, and Ho may be 1.0 mass % or less.

DETAILED EMBODIMENTS

Hereinafter, a sintered magnet which is an embodiment of the present invention is described using the figures. Note that, the present invention is not to be limited thereto.

The R-T-B based sintered magnet according to the present embodiment includes main phase grains consisting of an $R_2T_{14}B$ phase and grain boundaries formed between a plurality of main phase grains.

R is at least one of a rare earth element. T is Fe or a combination of Fe and Co. B is boron. Further, the R-T-B based sintered magnet includes M, and M includes at least one selected from Al, Si, P, Ti, Cr, Mn, Ni, Cu, Zn, Ga, Ge, Zr, Nb, Ag, In, Sn, Sb, Hf, Ta, W, and Bi. In addition, M includes Ga and Zr.

Figure 1:
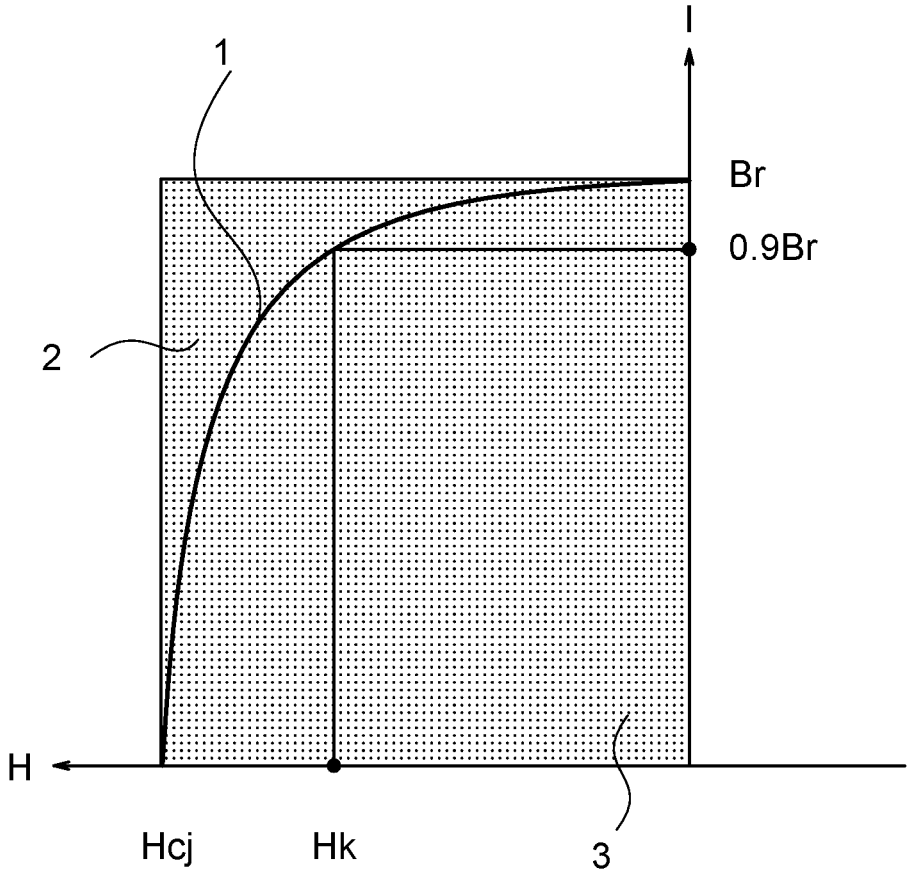
FIG. 1 is a second quadrant of I-H curve.
Figure 2:
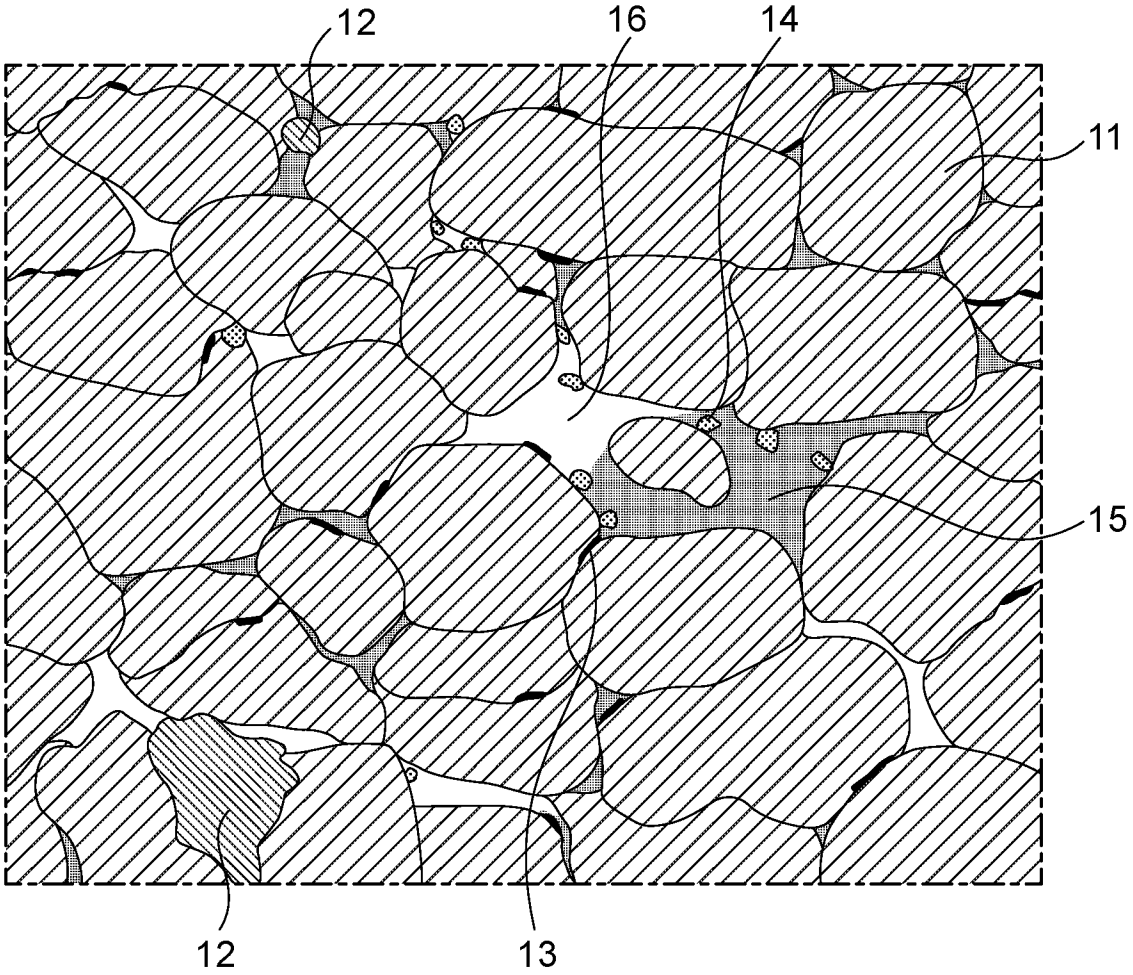
FIG. 2 is a schematic image of a cross section of a sintered magnet according to an embodiment of the present invention.

A schematic cross section image of the R-T-B based sintered magnet according to the present embodiment is shown in FIG. 2.

Figure 5:
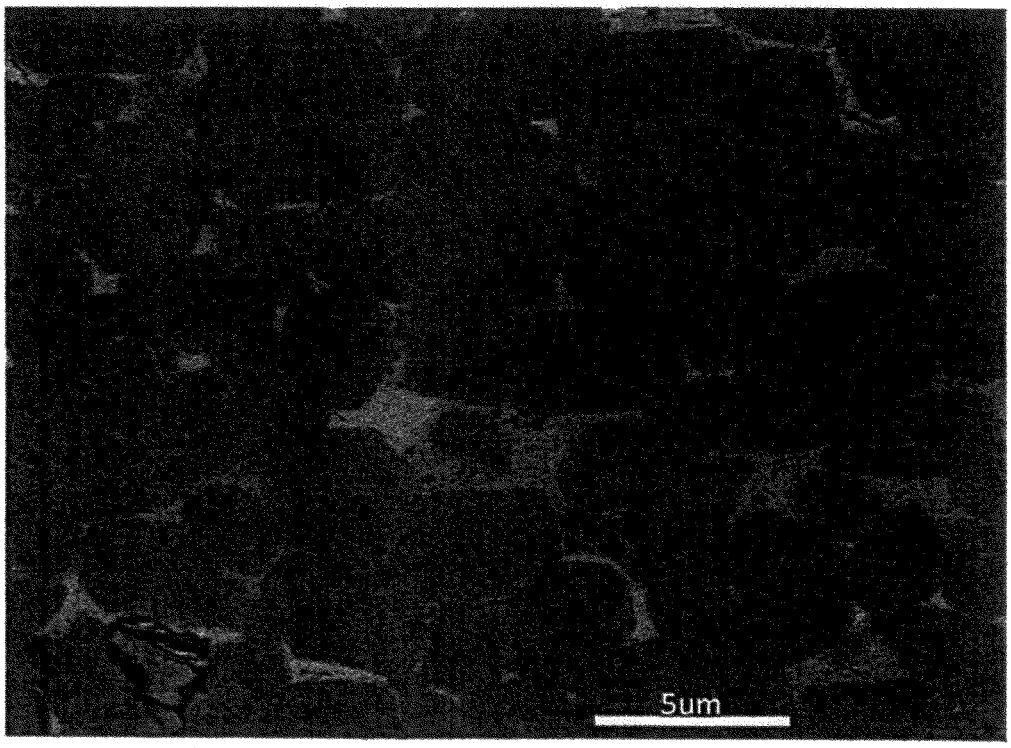
FIG. 5 is SEM image of a cross section of a permanent magnet of Example 1.

When the cross section of the R-T-B based sintered magnet according to the present embodiment is observed by a scattered electron image of SEM (hereinafter, it may be simply referred as SEM image), the main phase grains and a plurality of types of grain boundary phases existing in the grain boundaries can be seen as shown in FIG. 5. Further, the plurality of types of grain boundary phases has color shades depending on the composition, and shapes depending on a crystal type.

By carrying out a point analysis of each grain boundary phase using EPMA to make the composition clear, a type of the grain boundary phase can be identified.

Further, by verifying a crystal structure of each grain boundary phase using TEM, the grain boundary phase can be identified clearly. For example, for SEM image shown in FIG. 5, each grain boundary phase is identified and the schematic image thereof is shown in FIG. 2.

The R-T-B based permanent magnet according to the present embodiment includes, an $R_2T_{14}B$ phase 11, an R—O—C—N phase 12, a Zr—B phase 13, a Zr—C phase 14, an $R_6T_{13}Ga$ phase 15, and an R-rich phase 16.

The main phase grains are mainly consisting of the $R_2T_{14}B$ phase 11. Further, in some case, the Zr—B phase 13 and/or the Zr—C phase 14 may be included inside of the main phase grains.

The R—O—C—N phase 12 is included in the grain boundaries, and it is a compound having a cubic structure in which a ratio of O atom with respect to R atom is $0.4<(O/R)<0.7$. Note that, contents ratio of O, C, and N are not particularly limited, and preferably a ratio of N atom with respect to R atom is $0<(N/R)<1$.

The R—O—C—N phase 12 has a substantially circular shape or a substantially oval shape. Further, as shown in FIG. 5, the R—O—C—N phase has a shape which appears as if it rises out from other phases in SEM image. Thereby, the R—O—C—N phase 12 can be distinguished from other grain boundary phases even in SEM image. Also, when the R—O—C—N phase exists in a triple point grain boundary (which is formed by three or more adjacent main phase grains), the corrosion resistance can be improved.

The Zr—B phase 13 includes a Zr—B compound made of Zr and B. A type of the Zr—B compound is not particularly limited, and it is mainly $ZrB_2$ compound. For example, in an observation field of 20 μm×25 μm of the R-T-B based rare earth sintered magnet, 10 or more of Zr—B phases 13 may be formed.

Figure 4:
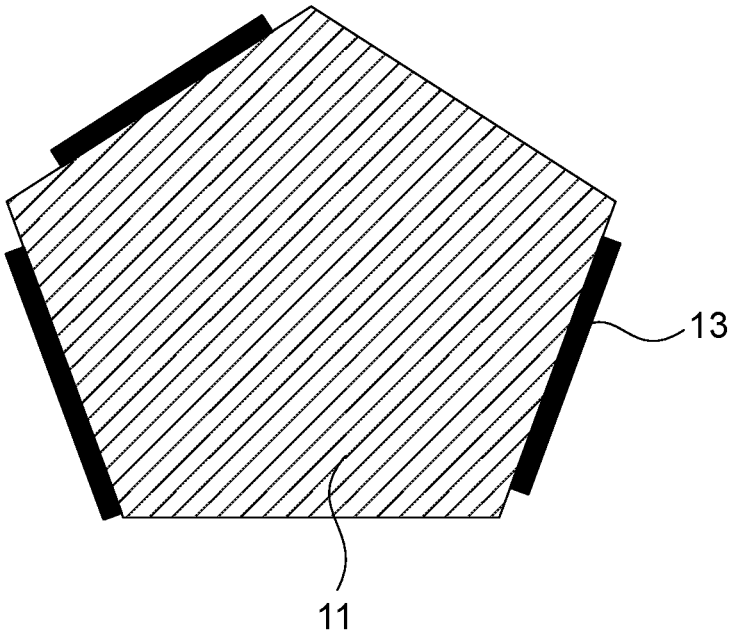
FIG. 4 is a schematic image showing a position relation between an $R_2T_{14}B$ phase and a Zr—B phase.

The Zr—B compound, particularly $ZrB_2$ compound, has an $AlB_2$ type hexagonal crystal structure. Therefore, the Zr—B compound is mainly a plate shape. As shown in FIG. 2 and FIG. 5, the Zr—B phase 13 is substantially rectangular shape in SEM image, and it is mainly included in a grain boundary between two main phase grains. Further, a schematic image of a position relation between the $R_2T_{14}B$ phase 11 and the Zr—B phase 13 is shown in FIG. 4. As shown in FIG. 4, the Zr—B phase 13 is substantially rectangular shape, thus an area where the Zr—B phase 13 and the $R_2T_{14}B$ phase 11 contact against each other becomes large. Therefore, the Zr—B phase 13 has an enhanced pinning effect of suppressing the abnormal grain growth of the main phase grains.

Also, the Zr—B phase 13 has a long side preferably of 300 nm or longer and 500 nm or shorter in average, and by having the long side within the above range, the effect of suppressing the abnormal grain growth is enhanced. Further, the Zr—B phase 13 may be included in the main phase grains. In such case, the Zr—B phase is included inside of the $R_2T_{14}B$ phase 11 in SEM image.

Note that, there is an effect of suppressing the abnormal grain growth even when a Ti—B phase including $TiB_2$ compound and a Hf—B phase including $HfB_2$ compound are included instead of the Zr—B phase 13. However, compared to the Zr—B phase 13, the Ti—B phase and the Hf—B phase tend to easily become smaller; hence it is difficult to have a long side of 300 nm or longer in average. Since the long side of the Ti—B phase and Hf—B phase are short, the effect of suppressing the abnormal grain growth is smaller compared to the Zr—B phase 13.

The Zr—C phase 14 includes a Zr—C compound made of Zr and C. A type of the Zr—C compound is not particularly limited, and it is mainly ZrC compound. For example, in an observation field of 20 μm×25 μm of the R-T-B based rare earth sintered magnet, 20 or more of Zr—C phases 14 may be formed.

Figure 3:
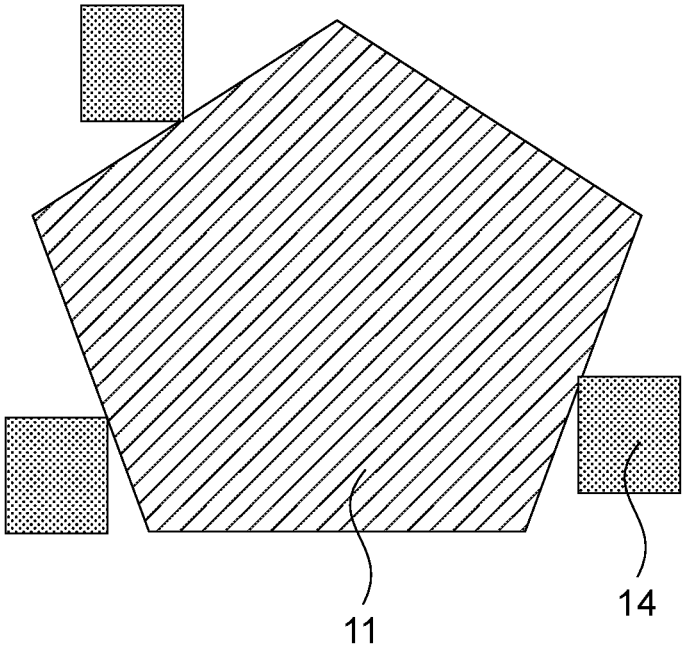
FIG. 3 is a schematic image showing a position relation between an $R_2T_{14}B$ phase and a Zr—C phase.

The Zr—C phase 14 is a crystal phase having a face-centered cubic structure (NaCl structure). By including the Zr—C phase 14 in the grain boundaries, the abnormal grain growth can be suppressed. However, the effect of suppressing the abnormal grain growth is thought to be smaller than the Zr—B phase 13. The Zr—C phase 14 can be precipitated inside of the $R_2T_{14}B$ phase 11 and in the grain boundary between two grains, but it tends to be precipitated mainly in the triple point grain boundary. Further, a schematic image of a position relation between the $R_2T_{14}B$ phase 11 and the Zr—C phase 14 is shown in FIG. 3. As shown in FIG. 3, the Zr—C phase 14 has a cubic shape, thus an area where the Zr—C phase 14 and the $R_2T_{14}B$ phase 11 contact against each other tends to become small easily. Therefore, the Zr—C phase 14 has a smaller pinning effect of suppressing the abnormal grain growth of the main phase grains compared to the Zr—B phase 13.

The Zr—C phase 14 is observed as a dark shade part in FIG. 5. Also, as shown in FIG. 2 and FIG. 5, the Zr—C phase 14 is very small polygonal shape.

In FIG. 5, the $R_6T_{13}Ga$ phase 15 is observed in the grain boundaries as a darker shade than the R-rich phase which will be described in below. Also, the $R_6T_{13}Ga$ phase is a compound having a $La_6Co_{11}Ga_3$ type crystal structure. For example, an area ratio of the $R_6T_{13}Ga$ phase with respect to an observation field of 20 μm×25 μm of the R-T-B based rare earth sintered magnet may be 1.0% or more and 10% or less, and it may be 3.0% or more and 7.0% or less. Also, in the $R_6T_{13}Ga$ phase 15, a $R_6T_{13}M'$ compound other than $R_6T_{13}Ga$ compound may be included. As M' of the $R_6T_{13}M'$ compound, for example, Al, Cu, Zn, In, P, Sb, Si, Ge, Sn, Bi, and the like may be mentioned. Note that, when the $R_6T_{13}Ga$ phase 15 is analyzed by EPMA, Ga content is preferably 3.0 at % or more and 8.0 at % or less.

By including the $R_6T_{13}Ga$ phase 15 in the grain boundaries, a magnetic separation between the main phase grains is increased, and the properties (particularly ofHcj) of the sintered magnet can be significantly improved. Also, the structure of the compound included in the $R_6T_{13}Ga$ phase 15 having the $La_6Co_{11}Ga_3$ type crystal structure can be verified for example by using TEM.

Also, a phase which is not shown in FIG. 2 and FIG. 5 may exist. Such phase is a compound having similar constituting element as the $R_6T_{13}Ga$ phase 15 and a crystal structure of a body centered cubic structure (hereinafter, this phase is referred to as a body centered cubic phase). T content in the body centered cubic phase is 10 at % or more and 50 at % or less. By including the body centered cubic phase in the grain boundaries as well, the magnetic separation between the main phase grains can be increased and the properties (particularly of Hcj) of the sintered magnet can be improved significantly. Note that, the structure of the body centered cubic phase having the body centered cubic structure can be verified using TEM.

R content in the R-rich phase 16 is 50 at % or more. The R-rich phase 16 is observed in the grain boundaries as a lighter shade compared to the $R_6T_{13}Ga$ phase 15. For example, an area ratio of the R-rich phase 16 with respect to an observation field of 20 μm×25 μm of the R-T-B based rare earth sintered magnet may be 1.0% or more and 10% or less, and it may be 3.5% or more and 8.0% or less.

Further, the R-T-B based sintered magnet according to the present embodiment preferably does not substantially include $R_2T_{17}$ phase. Specifically, an area ratio of the $R_2T_{17}$ phase with respect to an observation field of 20 μm×25 μm of the R-T-B based rare earth sintered magnet is preferably 0.5% or less. When the $R_2T_{17}$ phase is formed, the magnetic properties, particularly Br, tend to easily decrease, and also Hk/Hcj also decreases. Also, the $R_2T_{17}$ phase can be verified by EPMA.

In the R-T-B based sintered magnet according to the present embodiment,

R content is 29.0 mass % to 33.0 mass %,
B content is 0.85 mass % to 1.05 mass %,
Ga content is 0.30 mass % to 1.20 mass %,
O content is 0.03 mass % to 0.20 mass %,
C content is 0.03 mass % to 0.30 mass %,
where the R-T-B based sintered magnet is 100 mass %, and
the R-T-B based sintered magnet satisfies below (1) in which m(B) (mass %) is B content and m(Zr) (mass %) is Zr content.

$$3.48m(B)-2.67 \leq m(Zr) \leq 3.48m(B)-1.87 \quad (1)$$

R content is 29.0 mass % or more and 33.0 mass % or less. Preferably, it is 30.0 mass % or more and 32.0 mass % or less. It is not preferable when R content is too small, because a-Fe is easily formed while casting an alloy. Further, if a liquid phase component decreases during sintering, a change in a degree of shrinkage during sintering caused by a change in an amount of oxygen becomes large, and productivity decreases. In case R content is too much, a volume ratio of the $R_2T_{14}B$ phase 11 decreases, and Br decreases.

Also, a heavy rare earth element may be included as R, and particularly, at least one selected from Dy, Tb, and Ho may be included. As a heavy rare earth element content increases, Hcj improves but Br decreases. Also, a heavy rare earth element is mined from a limited area. Thus, costs increases by including a heavy rare earth element, and it is a risk from the point of depletion of resources. Therefore, a heavy rare earth element content is preferably small, and more preferably it is not used. Specifically, a heavy rare earth element content is preferably 1.0 mass % or less with respect to the entire rare earth magnet, and more preferably 0.5 mass % or less, and most preferably it is substantially not included. That is, most preferably, a heavy rare earth element content is 0.1 mass % or less.

B content is 0.85 mass % or more and 1.05 mass % or less. It may be 0.88 mass % or more and 1.05 mass % or less. Preferably, it is 0.88 mass % or more and 0.95 mass % or less. In case B content is too small, the Zr—B phase 13 is difficult to be formed sufficiently, and the abnormal grain growth suppression effect decreases. In case B content is too much, the Zr—B phase 13 may be formed too much, and the volume ratio of the $R_2T_{14}B$ phase 11 decreases and Br tends to decrease. Also, in order to widen a sintering temperature range in which the abnormal grain growth does not occur, B content is preferably 0.88 mass % or more. Further, in order to improve Br, B content is preferably 0.95 mass % or less.

The R-T-B based sintered magnet according to the present embodiment can have high magnetic properties even when a heavy rare earth element content is reduced and B content is 1.00 mass % or more and 1.05 mass % or less.

Ga content is 0.30 mass % or more and 1.20 mass % or less. In case Ga content is too small, the $R_6T_{13}Ga$ phase 15 is not formed sufficiently, and Hcj tends to easily decrease. In case Ga content is too much, the volume ratio of the $R_2T_{14}B$ phase 11 decreases and Br tends to easily decrease. Note that, preferably Ga content is 0.40 mass % or more and 1.00 mass % or less.

O content is 0.03 mass % or more and 0.20 mass % or less. Preferably, it is 0.05 mass % or more and 0.10 mass % or less. Oxygen is an inevitable impurity, thus it is difficult to reduce. In order to reduce to less than 0.03 mass %, an oxygen concentration in atmosphere during the production of the R-T-B based sintered magnet needs to be reduced, which increases the costs. On the other hand, if O content is too much, Hcj tends to easily decrease.

C content is 0.03 mass % or more and 0.30 mass % or less. Further, the following (2) is preferably satisfied in which m(C) (mass %) is C content.

$$0.0979m(\mathrm{Zr})-0.44m(\mathrm{B})+0.39\leq m(\mathrm{C})\leq 0.0979m(\mathrm{Zr})-0.44m(\mathrm{B})+0.49 \quad (2)$$

C content has an influence on a balance between the Zr—B phase 13 and the Zr—C phase 14 being formed. In case C content is too small, the Zr—B phase 13 is formed too much. In this case, B content other than the Zr—B phase decreases and the $R_2T_{17}$ phase is easily formed. On the other hand, in case C content is too much, an R—C phase including the compound formed of R and C is easily formed. When many R—C phases are formed, the R-rich phase 16 easily decreases, and Hcj easily decreases.

Zr content satisfies the above (1). In case Zr content is too small, the abnormal grain growth easily occurs, and Hcj easily decreases. In case Zr content is too much, the $R_2T_{17}$ phase is easily formed, and the magnetic properties, particularly Br, easily decrease and Hk/Hcj also decreases.

Zr content satisfies the below (1)'.

$$3.48m(\mathrm{B})-2.67\leq m(\mathrm{Zr})\leq 3.48m(\mathrm{B})-2.07 \quad (1)'$$

When (1)' is satisfied, both the Zr—B phase 13 and the Zr—C phase 14 are formed a lot. Further, the reaction of forming the R-rich phase 16 by reducing the R—C phase also proceeds. Therefore, Hcj can also be further increased.

The R-T-B based sintered magnet according to the present embodiment may include elements other than mentioned in above. For example, Co, Cu, and Al may be included.

Co content is not particularly limited. For example, Co content may be 0 mass % or more and 3.0 mass % or less when the entire R-T-B based sintered magnet is 100 mass %. Particularly, when Co content is 0.5 mass % or more and 2.5 mass % or less, it is preferable because the corrosion resistance and the temperature property are easily enhanced.

Cu content is not particularly limited. For example, Cu content may be 0.1 mass % or more and 0.6 mass % or less when the entire R-T-B based sintered magnet is 100 mass %. As Cu content increases, the corrosion resistance tends to be enhanced, but Br tends to decrease. Considering the balance between the corrosion resistance and Br, Cu content is preferably 0.2 mass % or more and 0.4 mass % or less.

Al content is not particularly limited. Also, Al may be included as an inevitable impurity. Al content may be 0.07 mass % or more and 1.0 mass % or less when the entire R-T-B based sintered magnet is 100 mass %. Preferably, it is 0.3 mass % or more and 0.6 mass % or less. As Al content increases, Hcj tends to increase, but Br tends to decrease. Further, Curie temperature of the $R_2T_{14}B$ phase 11 decreases and the temperature property tends to decrease.

The R-T-B based sintered magnet according to the present embodiment may further include N. Also, N may be included as an inevitable impurity. N content is 0.03 mass % or more and 0.20 mass % or less when the entire R-T-B based sintered magnet is 100 mass %. Preferably, it is 0.05 mass % or more and 0.12 mass % or less. In case N content is within the above range, the abnormal grain growth is easily suppressed.

Other element besides mentioned in above may be included as an inevitable impurity. A total content of inevitable impurity is preferably 0.2 mass % or less when the entire R-T-B based sintered magnet is 100 mass %.

The R-T-B based sintered magnet according to the present embodiment is a magnet having excellent magnetic properties. That is, the magnet has high Br, Hcj, and Hk/Hcj. Also, the R-T-B based sintered magnet according to the present embodiment further has a wider optimum sintering temperature range and a high production stability in addition to high magnetic properties.

Hereinafter, an example of a method of producing the R-T-B based sintering magnet according to the present embodiment is described. The method of producing the R-T-B based sintered magnet according to the present embodiment is not limited to below described method, but by producing by the below described method, the object of the present invention can be easily attained.

The R-T-B based sintered magnet according to the present embodiment can be produced by following method. The method of the present embodiment includes a preparation step preparing a raw material alloy, a pulverization step of pulverizing the raw material alloy into fine powder of a raw material, a pressing step forming a green compact by pressing the fine powder of the raw material, a sintering step sintering the green compact and obtaining a sintered body, and a heat treatment step carrying out an aging treatment to the sintered body.

The preparation step is a step of preparing the raw material alloy having each element included in the rare earth magnet according to the present embodiment. First, a raw material metal having predetermined element is prepared. A strip casting method and the like is carried out to this, and then melted and solidified, thereby the raw material alloy can be produced. As the raw material metal, for example, a rare earth metal or alloy of rare earth metal, iron, cobalt, ferro-borron, and alloys of these, and the like can be used. The raw material alloy enabling to obtain the rare earth magnet having the desired composition is prepared using these raw material metals.

Also, the raw material alloy may be carried out with a heating treatment in order to have uniform composition. C content included in the entire raw material alloy is 500 ppm or less, and preferably 300 ppm or less. When C content included in the raw material alloy is too much, Hcj of the R-T-B based sintered magnet obtained at the end decreases. When C content included in the raw material alloy is too small, the cost of the raw material alloy becomes expensive.

Here, the method of producing the R-T-B based sintered magnet according to the present embodiment may be a one-alloy method which uses one kind of alloy as the raw material alloy, or a two-alloy method which uses two kinds of alloy as raw material alloys. If B content in the raw material alloy is too small, a-Fe is easily precipitated in the raw material alloy, and the magnetic properties tend to decrease. Also, in the two-alloy method, a main phase alloy mainly forming the $R_2T_{14}B$ phase which is main phase, and a grain boundary phase alloy mainly forming other phase which is grain boundary phase can be casted separately. In this case, by including B only in the main phase alloy so that B is not included in the grain boundary phase alloy, B content in the main phase alloy can be relatively increased easily, hence it is preferable. In this case, a-Fe is easily precipitated in the grain boundary phase alloy, but by controlling a mixing ratio of the main phase alloy and the grain boundary phase alloy, the influence of a-Fe can be reduced.

The pulverization step is a step of obtaining raw material powder by pulverizing the raw material alloy obtained in the preparation step. This step is preferably carried out in two-steps, that is a coarse pulverization step and a fine pulverization step, but it may be done in one-step. For example, the coarse pulverization step can be carried out using a stamp mill, a jaw crusher, a brown mill, and the like, in inert gas atmosphere. Also, a hydrogen storage pulverization step can be carried out which pulverizes after storing hydrogen. The coarse pulverization is carried out until the particle size of the raw material alloy is several hundred μm to several mm or so. In case of carrying out the hydrogen storage pulverization, for example, dehydrogenation is carried out in Ar atmosphere or in vacuum atmosphere at 300 to 650° C.

The fine pulverization step is a step of preparing raw material powder having median particle size D50 of several μm or so by adding pulverization aid to the powder obtained in the coarse pulverization step, and then mixing and pulverizing. The median particle size of the raw material powder may be determined considering the particle size after sintering. The fine pulverization can be carried out for example by using a jet mill. There is no particular limit to a type of gas used in a jet mill, and for example, helium gas, nitrogen gas, or argon gas may be mentioned. The particle size of the raw material powder after the fine pulverization is not particularly limited, and the fine pulverization is preferably carried out so that D50 is 2.0 μm or more and 4.5 μm or less, and most preferably 2.5 μm or more and 3.5 μm or less. As D50 gets smaller, Hcj of the R-T-B based sintered magnet obtained at the end tends to improve, but also the abnormal grain growth tends to easily occur. Also, as D50 gets larger, the abnormal grain growth occurs less, and the sintering temperature range in which the abnormal grain growth does not occur becomes wider, but Hcj tends to decrease. Also, the atmosphere during the fine pulverization is preferably low oxygen atmosphere. Specifically, the atmosphere is preferably controlled so that an oxygen concentration is 100 ppm or less.

Also, a type of pulverization aid is not particularly limited, and for example, an organic lubricant such as oleic amide, lauric amide, zinc stearate, and the like; and a solid lubricant such as graphite, boron nitride (BN), and the like can be used. Particularly, boron nitride, graphite, and the like include the above mentioned element; hence by controlling the added amount, the composition of the R-T-B based sintered magnet obtained at the end can be controlled. Also, the pulverization aid may function as a pressing aid. The organic lubricant and the solid lubricant may be used independently, but more preferably these are mixed for use. Particularly, when using the solid lubricant alone, an orientation may decrease in some case.

The pressing step is a step of pressing the raw material powder in a magnetic field to produce a green compact. Specifically, the raw material powder is filled in a press mold held by an electromagnet, and then while applying a magnetic field by the electromagnet to orient a crystal axis of the raw material powder, the pressure is applied to the raw material powder, and thereby the pressing is done. This pressing in the magnetic field may be carried out, for example, by applying a magnetic field of 1000 kA/m or more and 1600 kA/m or less, and applying 30 MPa or more and 300 MPa or less or so of pressure.

The sintering step is a step of sintering the green compact to obtain the sintered body. After pressing in the magnetic field, sintering is carried out and the sintered body is obtained. Sintering conditions can be determined appropriately depending on conditions such as the composition of the green compact, the pulverization method of the raw material powder, the particle size, and the like. First, a temperature rising rate is preferably 10° C./min or slower when increasing the temperature to a holding temperature for sintering, and more preferably 3° C./min or faster and 5° C./min or slower. Also, the atmosphere when increasing the temperature is not particularly limited, and it may be in vacuum or inert gas atmosphere. The holding temperature is, for example, 1000° C. or higher and 1150° C. or lower. Also, preferably, it is 1050° C. or higher and 1130° C. or lower. The holding temperature is preferably a temperature in which the abnormal grain growth does not occur and has high Hk/Hcj. A holding time of the holding temperature is 2 hours or longer and 10 hours or shorter. Also, it is preferably 2 hours or longer and 5 hours or shorter considering the productivity. The atmosphere is preferably in vacuum atmosphere which is less than 100 Pa and more preferably less than 10 Pa while holding the temperature. Note that, after sintering, cooling may be carried out by rapid cooling at a rate of 30° C./min or faster.

The heat treatment step is a step of carrying out the aging treatment to the sintered body. This step determines the composition, the presence of each phase, and the like of the magnet obtained at the end. However, the composition and the presence of each phase are not controlled only by the heat treatment step, and these are controlled by balancing above mentioned various conditions of the sintering step and the conditions of fine powder of the raw material. Therefore, considering the relation between the grain boundary phase structure and the heat treatment condition, a heat treatment temperature (aging treatment temperature) and a heat treatment time (aging treatment time) may be determined. In the present embodiment, the heat treatment carried out in two-steps, that is a first aging treatment and a second aging treatment is described.

The first aging treatment may be carried out at a holding temperature of 800° C. or higher and 900° C. or lower. The atmosphere is preferably inert gas atmosphere having a pressure of atmospheric pressure or higher. As a type of inert gas, for example, helium gas and argon gas may be mentioned. The temperature rising rate at the first aging treatment may be 5° C./min or faster and 50° C./min or slower. The holding time may be 0.5 hours or longer and 4 hours or less. After the first aging treatment, rapid cooling may be carried out at a rate of 30° C./min or faster.

The second aging treatment may be carried out at a holding temperature of 450° C. or higher and 550° C. or lower. The atmosphere is preferably inert gas atmosphere having a pressure of atmospheric pressure or higher. As a type of inert gas, for example, helium gas and argon gas may be mentioned. A temperature rising rate at the second aging treatment may be 5° C./min or faster and 50° C./min or slower. A holding time may be 0.5 hours or longer and 4 hours or less. After the second aging treatment, rapid cooling may be carried out at a rate of 30° C./min or faster.

The R-T-B based sintered magnet according to the present embodiment can be obtained by the above method, but the method of producing the R-T-B based sintered magnet is not limited thereto and it may be modified accordingly.

Also, the R-T-B based permanent magnet according to the present invention is not limited to the R-T-B based sintered magnet produced by carrying out sintering. For example, the R-T-B based permanent magnet may be produced by carrying out a hot-forming or a hot-working instead of sintering.

When a hot-forming is carried out which applies pressure while heating to a cold-formed body obtained by pressing the raw material powder at room temperature, pores remaining in the cold-formed body disappear, and densification can be done without carrying out sintering. Further, by carrying out a hot-extrusion as a hot-working to the hot-formed body obtained by a hot-forming, the R-T-B based permanent magnet having desired shape and also having magnetic anisotropy can be obtained.

The R-T-B based sintered magnet according to the present invention has excellent magnetic properties. That is, the magnet having high Br, Hcj, and Hk/Hcj can be obtained.

EXAMPLES

Next, the present invention is described in detail based on specific examples; however the present invention is not to be limited thereto.

Examples 1 to 3 and Comparative Example 1

Raw material metals of a sintered magnet were prepared, and a raw material alloy was produced using the raw material metals by a strip casting method to obtain a rare earth magnet composition of Examples 1 to 3 and Comparative example 1 as shown in Table 1.

Next, a coarse pulverization was carried out. First, hydrogen storage was carried out to the above raw material alloy for 1 hour. Next, a temperature was increased at a temperature rising rate of 8° C./min while flowing argon, and was held at 600° C. for 1 hour to carry out a dehydrogenation treatment. Then, the temperature was lowered to room temperature and a coarsely pulverized powder having an average particle size of 100 μm or so was produced.

Next, a fine pulverization was carried out. To the above coarsely pulverized powder, 0.15 wt % of lauric amide was added as a pulverization and pressing aid. Then, the fine pulverization was carried out by a jet mill pulverization method. In the fine pulverization, nitrogen gas was used as a pulverization gas, and an oxygen concentration of the atmosphere was controlled to less than 100 ppm.

Next, pressing was carried out in a magnetic field, and a green compact was produced. Pressing in the magnetic field was carried out under a magnetic field orientation of 1200 kA/m and a pressure of 40 MPa, and the atmosphere during pressing was nitrogen atmosphere with oxygen concentration of less than 100 ppm.

Next, nine of the above green compacts were prepared. Then, sintering was performed to the prepared green compacts at a different sintering temperature. Specifically, a holding temperature during sintering was changed by 10° C. increments within the range of 1070 to 1150° C., thereby the sintered bodies were produced at different sintering temperatures.

Sintering was carried out by increasing the temperature of the above green compact at a temperature rising rate of 4° C./min, and by holding at the above holding temperature for 4 hours. Further, after holding the temperature for 4 hours, it was rapidly cooled to 50° C. at a temperature cooling rate of 50° C./min or faster, thereby the sintering body was obtained.

Next, the temperature of the sintered body was increased at a temperature rising rate of 8° C./min, and held at 900° C. for 1 hour, then the temperature was rapidly cooled to 50° C. at a temperature cooling rate of 50° C./min or faster, thereby the first aging treatment was carried out. Further, the temperature of the sintered body after the first aging treatment was increased by a temperature rising rate of 8° C./min, and held at 500° C. for 1 hour, then the temperature was rapidly cooled to 50° C. at a temperature cooling rate of 50° C./min or faster, thereby the second aging treatment was carried out.

Next, an optimum sintering temperature range for each example and comparative example was determined. Specifically, the optimum sintering temperature range was defined as the range of the sintering temperature capable of obtaining the sintered body without an abnormal grain growth and having Hk/Hcj of 95% or more. Note that, the optimum sintering temperature range is preferably 20° C. or wider, and more preferably 30° C. or wider from the point of mass-production. Also, among the sintering temperature included in the optimum sintering temperature range, the temperature having the best magnetic properties was defined as an optimum sintering temperature.

As for the presence of the abnormal grain growth, specifically, when a grain having a grain size larger than 100 μm was found, then it was determined that the abnormal grain growth did occur. First, the sintered body was partially fractured so that 10 mm×10 mm or larger area for measuring can be secured, then the fracture surface was observed visually and by an optical microscope of 20× magnification. In case the coarse grain possibly having a grain size larger than 100 μm was observed, SEM was used for further observation, and verified whether the coarse grain has a grain size larger than 100 μm.

The magnetic properties (Br, Hcj, and Hk/Hcj) of each sintered body were measured by a BH curve tracer (TRF made by TOEI-KOGYO.Co.LTD). The results are shown in Table 2. Note that, the magnetic properties shown in Table 2 are the magnetic properties of the sintered body which was sintered at the optimum sintering temperature. When Br was 1305 mT or more, it was considered good. When Hcj was 1432 kA/m or more, it was considered good. When Hk/Hcj was 95% or more, it was considered good.

Also, the composition of each sintered body was measured by a fluorescent X-ray analysis and ICP emission spectroscopy. ICP emission spectroscopy was used only for measuring B content, and the fluorescent X-ray analysis was used for measuring other elements. The results are shown in Table 1. Note that, the composition shown in Table 1 is the composition of the sintered body which was sintered at the optimum sintering temperature. For the comparative example of which the optimum sintering temperature range is 0, the composition and magnetic properties of the sintered body sintered at the sintering temperature having largest Hk/Hcj are shown in Table 1 and Table 2.

Further, separately from the above fracture surface, a polished cross section obtained by polishing after fracturing the sintered body sintered at the optimum sintering temperature was observed by SEM and EPMA at 5000× magnification. Then, the type of each phase existing in the polished cross section was identified. Specifically, it was categorized into plurality of phases according to shades of a backscattered electron image of SEM. Then, for each phase which was categorized, the type was identified by comparing with the result of EPMA mapping.

FIG. 5 shows SEM image of Example 1. Note that, FIG. 2 is a schematic image of part of FIG. 5. In FIG. 5, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. The Zr—B phase 13 had a plate shape or a needle shape, and the Zr—C phase 14 had a cubic shape. Also, the Zr—B phase 13 and the Zr—C phase 14 were found in main phase grains and also in grain boundaries. The R—O—C—N phase 12 and the $R_6T_{13}Ga$ phase 15 were found only in the grain boundaries. Further, an average length of a long side of the Zr—B phase 13 was calculated from at least 10 of Zr—B phases 13. For Example 1, it was 440 nm.

Also, in Example 2 and Example 3, as similar to Example 1, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. The Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

On the contrary, Comparative example 1 having excessive Zr content had an $R_2T_{17}$ phase at all of the sintering temperatures, and Br and Hk/Hcj were decreased.

Examples 4 to 6 and Comparative Example 2

A sintered body was produced and various measurements were carried out as same as Examples 1 to 3 and Comparative Example 1, except that a raw material alloy was produced to obtain a rare earth magnet composition of Examples 4 to 6 and Comparative example 2 as shown in Table 1. The results are shown in Table 1 and Table 2.

Examples 4 to 6 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. The Zr—B phase 13 and the Zr—C phase 14 were confirmed inside of main phase grains and also in grain boundaries. The R—O—C—N phase 12 and the $R_6T_{13}Ga$ phase 15 were confirmed only in the grain boundaries. The average length of the long side of the Zr—B phase 13 was calculated, and it was within the range of 300 nm to 500 nm.

On the contrary, as similar to Comparative example 1, Comparative example 2 having excessive Zr content had an $R_2T_{17}$ phase at all of the sintering temperatures, and Br and Hk/Hcj were decreased.

Examples 7 to 9 and Comparative Example 3

A sintered body was produced and various measurements were carried out as same as Examples 1 to 3 and Comparative Example 1, except that a raw material alloy was produced to obtain a rare earth magnet composition of Examples 7 to 9 and Comparative example 3 as shown in Table 1. The results are shown in Table 1 and Table 2.

Examples 7 to 9 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. The Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

On the contrary, as similar to Comparative example 1, Comparative example 3 having excessive Zr content had an $R_2T_{17}$ phase at all of the sintering temperatures, and Br and Hk/Hcj were decreased.

Examples 10 to 12 and Comparative Example 4

A sintered body was produced and various measurements were carried out as same as Examples 1 to 3 and Comparative Example 1, except that a raw material alloy was produced to obtain a rare earth magnet composition of Examples 10 to 12 and Comparative example 4 as shown in Table 1. The results are shown in Table 1 and Table 2.

Examples 10 to 12 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. The Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

On the contrary, as similar to Comparative example 1, Comparative example 4 having excessive Zr content had an $R_2T_{17}$ phase at all of the sintering temperatures, and Br and Hk/Hcj were decreased.

Examples 13 and 14 and Comparative Example 5

A sintered body was produced and various measurements were carried out as same as Examples 1 to 3 and Comparative Example 1, except that an added amount of lauric amide was changed to 0.10 wt % and a raw material alloy was produced to obtain a rare earth magnet composition of Examples 13 and 14 and Comparative example 5 shown in Table 1. The results are shown in Table 1 and Table 2.

Examples 13 and 14 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and R-rich phase 16 were confirmed. However, an $R_2T_{17}$ phase was not confirmed. Also, the Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

On the contrary, as similar to Comparative example 1, Comparative example 5 having excessive Zr content had an $R_2T_{17}$ phase at all of the sintering temperatures, and Br and Hk/Hcj were decreased. Also, the Zr—C phase 14 was found only in the grain boundaries, and was not found in the main phase grains.

Example 15

A sintered body was produced and various measurements were carried out as same as Examples 1 to 3 and Comparative Example 1, except that an pulverization and pressing aid was changed to 0.08 wt % of lauric amide and 0.06 wt % of boron nitride (BN), and a raw material alloy was produced to obtain a rare earth magnet composition of Example 15 as shown in Table 1. The results are shown in Table 1 and Table 2.

Example 15 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. Also, the Zr—B phase 13 was found in main phase grains and also in grain boundaries, but the Zr—C phase 14 was only found in the grain boundaries and was not found in the main phase grains. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

Comparative Examples 6 to 9

Figure 6:
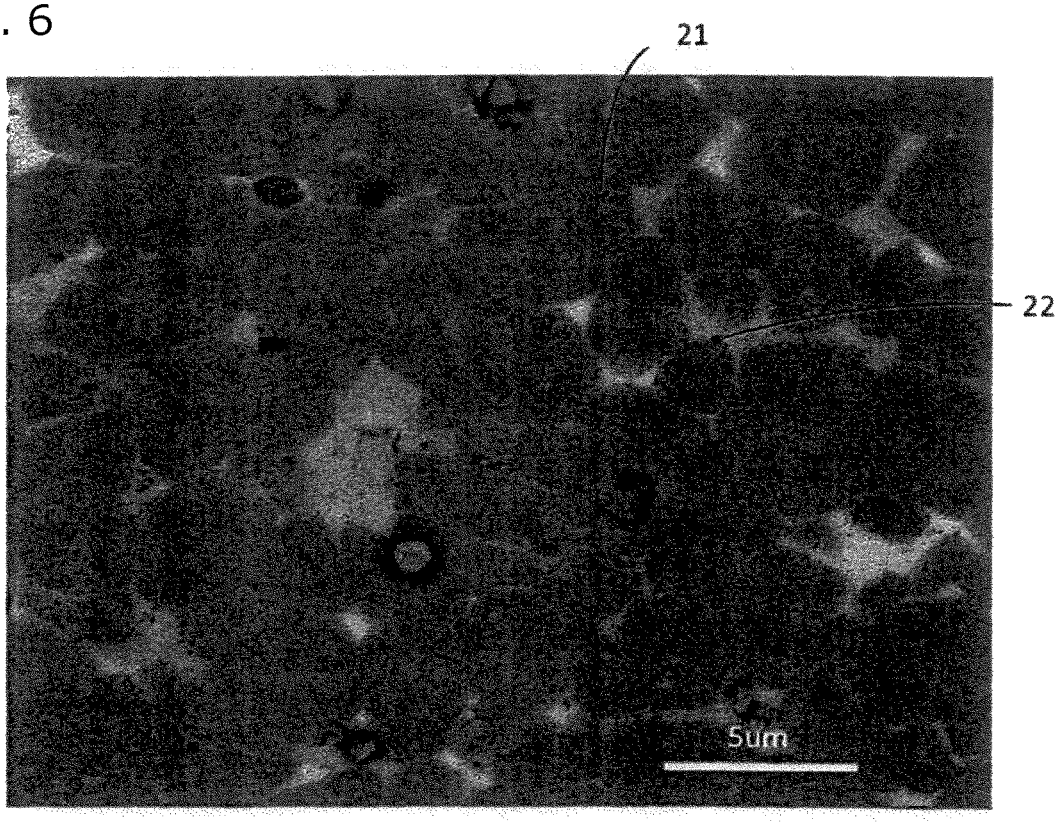
FIG. 6 is SEM image of a cross section of a permanent magnet of Comparative example 7.

A sintered body was produced and various measurements were carried out as same as Examples 1 to 3 and Comparative Example 1, except that an added amount of lauric amide was changed to 0.10 wt % and a raw material alloy was produced to obtain a rare earth magnet composition of Comparative examples 6 to 9 as shown in Table 1. The results are shown in Table 1 and Table 2. Note that, for Comparative example 7, SEM observation result is shown in FIG. 6.

Comparative examples 6 to 9 of which Zr content was too small did not have the Zr—B phase 13 and the Zr—C phase 14, and instead, a Ti—B phase 21 and a Ti—C phase 22 were confirmed. The Ti—B phase 21 and the Ti—C phase 22 were found in main phase grains and also in grain boundaries. Further, Comparative example 7 had the average length of the long side of the Ti—B phase 21 of 203 nm. Also, for other comparative examples, the average length of the long side of the Ti—B phase was about the same as Comparative example 7, which was below 300 nm. Further, as obvious from FIG. 5 and FIG. 6, the Ti—B phase 21 and the Ti—C phase 22 were smaller than the Zr—B phase 13 and the Zr—C phase 14.

Also, in Comparative example 9 having large Ti content, an $R_2T_{17}$ phase was confirmed at all of the sintering temperature, and Br and Hk/Hcj were decreased.

Comparative examples 6 to 8 had good magnetic properties. However, the optimum sintering temperature range was 10° C., which was narrow, and the abnormal grain growth easily occurred.

The reason that the abnormal grain growth easily occurred particularly in Comparative examples 6 to 8 compared to the examples is thought because the Ti—B phase 21 and the Ti—C phase 22 were smaller compared to the Zr—B phase 13 and Zr—C phase 14 of the examples, and also the amount of these found in the grain boundaries was small. Since the sizes of Ti—B phase 21 and Ti—C phase 22 were small, the effect of suppressing the abnormal grain growth was thought to be decreased.

Comparative Examples 10 to 12

Figure 7:
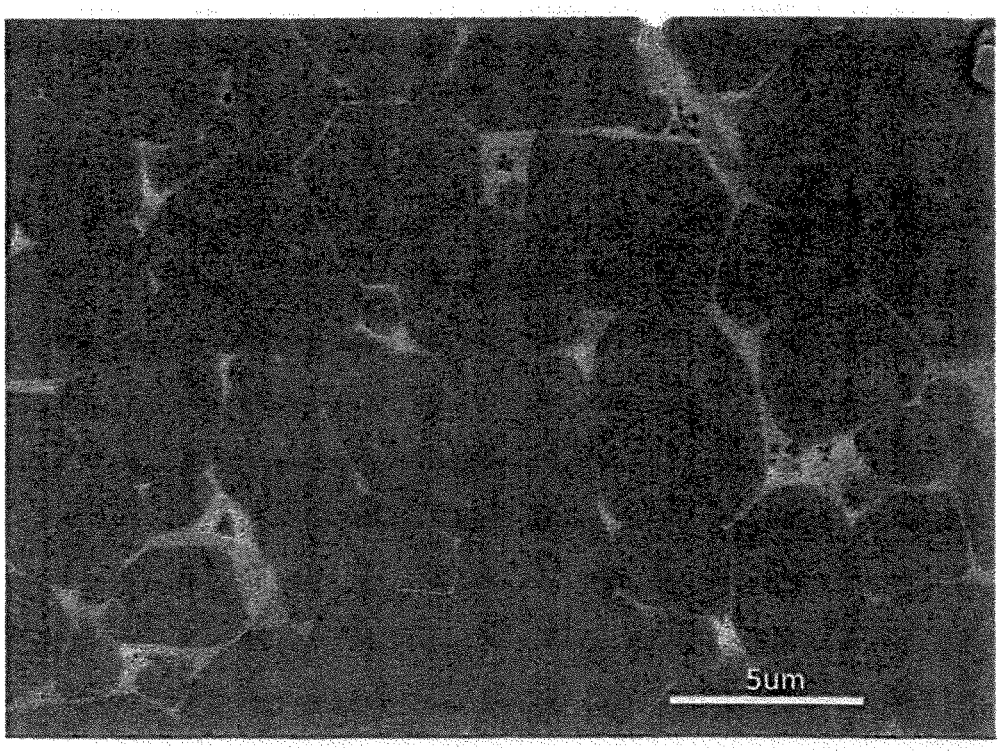
FIG. 7 is SEM image of a cross section of a permanent magnet of Comparative example 10.

A sintered body was produced and various measurements were carried out as same as Examples 1 to 3 and Comparative Example 1, except that a raw material alloy was produced to obtain a rare earth magnet composition of Comparative examples 10 to 12 as shown in Table 1. The results are shown in Table 1 and Table 2. Note that, for Comparative example 10, SEM observation result is shown in FIG. 7.

In Comparative examples 10 to 12 of which B content was too small, a Zr—B phase 13 was not confirmed. Also, as shown in FIG. 7, in Comparative example 10, a Zr—C phase 14 was confirmed only in the grain boundaries. Further, in Comparative example 12 having excessive Zr content, an $R_2T_{17}$ phase was confirmed.

In Comparative example 10, the abnormal grain growth occurred at all of the sintering temperatures, and Hk/Hcj decreased. Also, Comparative example 11 had good magnetic properties. However, the optimum sintering temperature range was 10° C., which was narrow, and the abnormal grain growth easily occurred. In Comparative example 12, the $R_2T_{17}$ phase was found at all of the sintering temperatures, hence Hk/Hcj decreased.

Comparative Example 13

A sintered body was produced and various measurements were carried out as same as Examples 1 to 3 and Comparative Example 1, except that an pulverization and pressing aid was changed to 0.12 wt % of boron nitride (BN) and a raw material alloy was produced to obtain a rare earth magnet composition of Comparative example 13 as shown in Table 1. The results are shown in Table 1 and Table 2.

In Comparative example 13 having excessive B content, a Zr—C phase was found only in grain boundaries. The abnormal grain growth was not confirmed at all of the sintering temperatures, but Br and Hk/Hcj were decreased. In Comparative example 13, a Zr—B phase was produced too much because of excessive B content. Also, because the Zr—B phase was produced too much, the main phase volume ratio decreased. Further, in Comparative example 13, only boron nitride (BN) was used as the solid lubricant. Since the main phase volume ratio decreased and boron nitride (BN) was only used as the solid lubricant, the orientation decreased. As a result of the decreased orientation, Br and Hk/Hcj were thought to be decreased.

Examples 16 and 17

A sintered body was produced and various measurements were carried out as same as Examples 1 to 3 and Comparative Example 1, except that a raw material alloy was produced to obtain a rare earth magnet composition of Examples 16 and 17 as shown in Table 1. The results are shown in Table 1 and Table 2.

Examples 16 and 17 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed.

The Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

Examples 18 to 25 and Comparative Example 14

A sintered body was produced and various measurements were carried out as same as Examples 1 to 3 and Comparative Example 1, except that an added amount of lauric amide was controlled so that a sintered body had C content as shown in Table 1 and a raw material alloy was produced to obtain a rare earth magnet composition of Examples 18 to 25 and Comparative example 14 as shown in Table 1. The results are shown in Table 1 and Table 2.

Examples 18 to 22 had same condition except for C content, and all of these had Zr content satisfying the above (1) and C content satisfying (2). Examples 18 to 22 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. Also, the Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

Examples 23 to 25 which had same condition except for Zr content, and all of these had Zr content satisfying the above (1) and C content satisfying (2). Examples 23 to 25 had good magnetic properties as similar to Examples 1 to 3, and also had a good optimum sintering temperature range. Further, an $R_2T_{14}B$ phase 11, an R—O—C—N phase 12, a Zr—B phase 13, a Zr—C phase 14, an $R_6T_{13}Ga$ phase 15, and an R-rich phase 16 were confirmed. However, an $R_2T_{17}$ phase was not confirmed. The Zr—B phase 13 and the Zr—C phase 14 were found in main phase grains and also in grain boundaries. The R—O—C—N phase 12 and the $R_6T_{13}Ga$ phase 15 were found only in the grain boundaries. The average length of the long side of the Zr—B phase 13 was calculated, and it was within the range of 300 nm to 500 nm.

On the other hand, in Comparative example 14 not satisfying the above (1) and (2) because of excessive Zr content, the $R_2T_{17}$ phase was found. Further, Br and Hk/Hcj decreased at all of the sintering temperatures.

Examples 26 to 31 were same as Example 1 except that Ga content was varied. Even when Ga content was varied within the range of the present invention, a wide optimum sintering temperature range and good magnetic properties were confirmed.

TABLE 1

| | R | | | | T | | B | M |
|---|---|---|---|---|---|---|---|---|
| | Nd (mass %) | Pr (mass %) | Dy (mass %) | Total (mass %) | Fe (mass %) | Co (mass %) | B (mass %) | Al (mass %) |
| Example 1 | 23.7 | 7.16 | 0.0 | 30.9 | 64.0 | 2.0 | 1.00 | 0.38 |
| Example 2 | 23.7 | 7.15 | 0.0 | 30.9 | 63.7 | 2.0 | 1.01 | 0.36 |
| Example 3 | 23.7 | 7.14 | 0.0 | 30.9 | 63.4 | 2.0 | 1.01 | 0.36 |
| Comparative example 1 | 23.8 | 7.14 | 0.0 | 31.0 | 63.1 | 2.0 | 1.02 | 0.35 |
| Example 4 | 23.7 | 7.14 | 0.0 | 30.9 | 64.2 | 2.0 | 0.97 | 0.37 |
| Example 5 | 23.8 | 7.16 | 0.0 | 31.0 | 63.8 | 2.0 | 0.97 | 0.36 |
| Example 6 | 23.7 | 7.13 | 0.0 | 30.9 | 63.6 | 2.0 | 0.98 | 0.35 |
| Comparative example 2 | 23.8 | 7.15 | 0.0 | 31.0 | 63.2 | 2.0 | 0.98 | 0.35 |
| Example 7 | 23.7 | 7.13 | 0.0 | 30.9 | 64.3 | 2.0 | 0.94 | 0.36 |
| Example 8 | 23.9 | 7.17 | 0.0 | 31.0 | 63.8 | 2.0 | 0.93 | 0.36 |
| Example 9 | 23.7 | 7.13 | 0.0 | 30.9 | 63.7 | 2.0 | 0.94 | 0.34 |
| Comparative example 3 | 23.8 | 7.17 | 0.0 | 31.0 | 63.3 | 2.0 | 0.95 | 0.34 |
| Example 10 | 23.8 | 7.22 | 0.0 | 31.0 | 64.3 | 2.0 | 0.88 | 0.39 |
| Example 11 | 23.9 | 7.24 | 0.0 | 31.1 | 63.9 | 2.0 | 0.89 | 0.39 |
| Example 12 | 23.7 | 7.14 | 0.0 | 30.9 | 63.9 | 2.0 | 0.89 | 0.36 |
| Comparative example 4 | 23.7 | 7.13 | 0.0 | 30.9 | 63.6 | 2.0 | 0.91 | 0.35 |
| Example 13 | 23.7 | 7.11 | 0.0 | 30.8 | 64.4 | 2.0 | 0.94 | 0.37 |
| Example 14 | 23.8 | 7.13 | 0.0 | 30.9 | 64.0 | 2.0 | 0.95 | 0.36 |
| Comparative example 5 | 23.7 | 7.14 | 0.0 | 30.9 | 63.4 | 2.0 | 0.96 | 0.35 |
| Example 15 | 23.8 | 7.18 | 0.0 | 31.0 | 64.0 | 2.0 | 0.98 | 0.37 |
| Comparative example 6 | 23.9 | 7.21 | 0.0 | 31.2 | 64.5 | 2.0 | 0.98 | 0.35 |
| Comparative example 7 | 24.0 | 7.23 | 0.0 | 31.2 | 64.4 | 2.0 | 0.98 | 0.36 |
| Comparative example 8 | 24.1 | 7.26 | 0.0 | 31.3 | 64.2 | 2.0 | 0.98 | 0.38 |
| Comparative example 9 | 24.0 | 7.23 | 0.0 | 31.2 | 64.3 | 2.0 | 0.98 | 0.37 |
| Comparative example 10 | 23.9 | 7.32 | 0.0 | 31.2 | 64.4 | 2.0 | 0.82 | 0.36 |
| Comparative example 11 | 23.9 | 7.31 | 0.0 | 31.2 | 64.2 | 2.0 | 0.82 | 0.35 |

TABLE 1-continued

| | | | | | | | | |
|---|---|---|---|---|---|---|---|---|
| Comparative example 12 | 23.8 | 7.21 | 0.0 | 31.1 | 63.8 | 1.9 | 0.83 | 0.38 |
| Comparative example 13 | 23.9 | 7.22 | 0.0 | 31.1 | 63.8 | 2.0 | 1.08 | 0.37 |
| Example 16 | 23.9 | 7.17 | 0.5 | 31.5 | 63.8 | 2.0 | 0.93 | 0.36 |
| Example 17 | 23.9 | 7.17 | 1.0 | 32.0 | 63.8 | 2.0 | 0.93 | 0.36 |
| Example 18 | 23.8 | 7.13 | 0.0 | 30.9 | 64.0 | 2.0 | 0.95 | 0.36 |
| Example 19 | 23.8 | 7.14 | 0.0 | 30.9 | 63.9 | 2.0 | 0.94 | 0.35 |
| Example 20 | 23.8 | 7.15 | 0.0 | 30.9 | 63.9 | 2.0 | 0.94 | 0.36 |
| Example 21 | 23.8 | 7.15 | 0.0 | 31.0 | 63.9 | 1.9 | 0.94 | 0.36 |
| Example 22 | 23.8 | 7.13 | 0.0 | 30.9 | 64.0 | 2.0 | 0.95 | 0.36 |
| Example 23 | 23.8 | 7.18 | 0.0 | 31.0 | 63.7 | 2.0 | 1.05 | 0.38 |
| Example 24 | 23.8 | 7.17 | 0.0 | 31.0 | 63.4 | 2.0 | 1.04 | 0.37 |
| Example 25 | 23.7 | 7.14 | 0.0 | 30.9 | 63.3 | 2.0 | 1.04 | 0.36 |
| Comparative example 14 | 23.8 | 7.16 | 0.0 | 31.0 | 62.8 | 2.0 | 1.05 | 0.35 |
| Example 26 | 23.8 | 7.19 | 0.0 | 31.0 | 63.4 | 2.0 | 0.95 | 0.38 |
| Example 27 | 23.9 | 7.13 | 0.0 | 31.0 | 63.8 | 2.0 | 0.95 | 0.39 |
| Example 28 | 23.9 | 7.19 | 0.0 | 31.1 | 63.6 | 2.0 | 0.95 | 0.39 |
| Example 29 | 23.9 | 7.24 | 0.0 | 31.1 | 63.3 | 2.0 | 0.95 | 0.38 |
| Example 30 | 23.9 | 7.22 | 0.0 | 31.1 | 63.2 | 2.0 | 0.96 | 0.39 |
| Example 31 | 23.8 | 7.17 | 0.0 | 30.9 | 63.2 | 2.0 | 0.96 | 0.37 |

| | M | | | | | | |
|---|---|---|---|---|---|---|---|
| | Cu (mass %) | Ga (mass %) | Zr (mass %) | Ti (mass %) | O (mass %) | N (mass %) | C (mass %) |
| Example 1 | 0.30 | 0.44 | 0.92 | — | 0.06 | 0.06 | 0.11 |
| Example 2 | 0.30 | 0.45 | 1.22 | — | 0.06 | 0.07 | 0.12 |
| Example 3 | 0.30 | 0.45 | 1.52 | — | 0.07 | 0.07 | 0.12 |
| Comparative example 1 | 0.30 | 0.44 | 1.81 | — | 0.06 | 0.07 | 0.11 |
| Example 4 | 0.30 | 0.44 | 0.82 | — | 0.07 | 0.06 | 0.11 |
| Example 5 | 0.30 | 0.45 | 1.12 | — | 0.07 | 0.06 | 0.11 |
| Example 6 | 0.30 | 0.44 | 1.43 | — | 0.07 | 0.07 | 0.11 |
| Comparative example 2 | 0.30 | 0.44 | 1.72 | — | 0.06 | 0.07 | 0.11 |
| Example 7 | 0.30 | 0.44 | 0.71 | — | 0.07 | 0.06 | 0.11 |
| Example 8 | 0.30 | 0.44 | 1.02 | — | 0.07 | 0.06 | 0.11 |
| Example 9 | 0.30 | 0.44 | 1.33 | — | 0.07 | 0.07 | 0.11 |
| Comparative example 3 | 0.30 | 0.44 | 1.63 | — | 0.06 | 0.07 | 0.10 |
| Example 10 | 0.30 | 0.45 | 0.50 | — | 0.07 | 0.06 | 0.12 |
| Example 11 | 0.30 | 0.45 | 0.81 | — | 0.06 | 0.06 | 0.12 |
| Example 12 | 0.30 | 0.45 | 1.12 | — | 0.06 | 0.07 | 0.11 |
| Comparative example 4 | 0.30 | 0.45 | 1.42 | — | 0.06 | 0.07 | 0.11 |
| Example 13 | 0.30 | 0.45 | 0.71 | — | 0.06 | 0.06 | 0.09 |
| Example 14 | 0.30 | 0.44 | 1.02 | — | 0.06 | 0.07 | 0.09 |
| Comparative example 5 | 0.31 | 0.45 | 1.62 | — | 0.06 | 0.07 | 0.10 |
| Example 15 | 0.30 | 0.45 | 0.87 | — | 0.07 | 0.10 | 0.07 |
| Comparative example 6 | 0.31 | 0.46 | 0.21 | 0.38 | 0.05 | 0.05 | 0.12 |
| Comparative example 7 | 0.31 | 0.46 | 0.21 | 0.54 | 0.06 | 0.05 | 0.12 |
| Comparative example 8 | 0.31 | 0.47 | 0.21 | 0.69 | 0.06 | 0.05 | 0.12 |
| Comparative example 9 | 0.31 | 0.47 | 0.21 | 0.85 | 0.06 | 0.06 | 0.12 |
| Comparative example 10 | 0.30 | 0.47 | 0.20 | — | 0.05 | 0.06 | 0.12 |
| Comparative example 11 | 0.30 | 0.47 | 0.52 | — | 0.07 | 0.06 | 0.15 |
| Comparative example 12 | 0.31 | 0.47 | 1.03 | — | 0.05 | 0.06 | 0.13 |
| Comparative example 13 | 0.30 | 0.45 | 1.22 | — | 0.07 | 0.14 | 0.03 |
| Example 16 | 0.30 | 0.44 | 1.02 | — | 0.07 | 0.06 | 0.11 |
| Example 17 | 0.30 | 0.44 | 1.02 | — | 0.07 | 0.06 | 0.11 |
| Example 18 | 0.30 | 0.44 | 1.02 | — | 0.06 | 0.07 | 0.09 |
| Example 19 | 0.30 | 0.45 | 1.02 | — | 0.07 | 0.07 | 0.10 |
| Example 20 | 0.30 | 0.44 | 1.02 | — | 0.07 | 0.07 | 0.13 |
| Example 21 | 0.30 | 0.44 | 1.02 | — | 0.07 | 0.06 | 0.15 |
| Example 22 | 0.30 | 0.44 | 1.02 | — | 0.07 | 0.07 | 0.16 |
| Example 23 | 0.30 | 0.45 | 1.13 | — | 0.07 | 0.06 | 0.12 |
| Example 24 | 0.30 | 0.45 | 1.43 | — | 0.06 | 0.07 | 0.12 |
| Example 25 | 0.30 | 0.45 | 1.72 | — | 0.07 | 0.07 | 0.12 |

TABLE 1-continued

| | | | | | | | |
|---|---|---|---|---|---|---|---|
| Comparative example 14 | 0.31 | 0.45 | 2.04 | — | 0.07 | 0.08 | 0.11 |
| Example 26 | 0.30 | 0.30 | 1.00 | — | 0.06 | 0.06 | 0.11 |
| Example 27 | 0.30 | 0.45 | 1.00 | — | 0.05 | 0.06 | 0.11 |
| Example 28 | 0.30 | 0.62 | 1.01 | — | 0.06 | 0.06 | 0.11 |
| Example 29 | 0.30 | 0.79 | 1.00 | — | 0.06 | 0.06 | 0.12 |
| Example 30 | 0.30 | 0.98 | 1.00 | — | 0.06 | 0.06 | 0.12 |
| Example 31 | 0.30 | 1.18 | 1.00 | — | 0.05 | 0.06 | 0.11 |

TABLE 2

| | | | | Optimum sintering temperature | Presence of each phase | | | | |
|---|---|---|---|---|---|---|---|---|---|
| | | | | | Zr-B phase | | Zr-C phase | | |
| | Br (mT) | Hcj (kA/m) | Hk/Hcj (%) | range (° C.) | grain bounadry | inside of main phase grains | grain bounadry | inside of main phase grains | R2-T17 phase |
| Example 1 | 1382 | 1504 | 98.90 | 40 | present | present | present | present | not present |
| Example 2 | 1355 | 1574 | 98.03 | 40 | present | present | present | present | not present |
| Example 3 | 1346 | 1586 | 98.06 | 40 | present | present | present | present | not present |
| Comparative example 1 | 1301 | 1561 | 85.82 | 0 | present | present | present | present | present |
| Example 4 | 1386 | 1522 | 98.96 | 40 | present | present | present | present | not present |
| Example 5 | 1364 | 1585 | 98.40 | 40 | present | present | present | present | not present |
| Example 6 | 1350 | 1569 | 98.24 | 40 | present | present | present | present | not present |
| Comparative example 2 | 1293 | 1573 | 65.05 | 0 | present | present | present | present | present |
| Example 7 | 1389 | 1540 | 99.02 | 40 | present | present | present | present | not present |
| Example 8 | 1372 | 1596 | 98.77 | 30 | present | present | present | present | not present |
| Example 9 | 1354 | 1552 | 98.41 | 30 | present | present | present | present | not present |
| Comparative example 3 | 1284 | 1585 | 44.28 | 0 | present | present | present | present | present |
| Example 10 | 1409 | 1478 | 99.12 | 30 | present | present | present | present | not present |
| Example 11 | 1376 | 1616 | 99.05 | 20 | present | present | present | present | not present |
| Example 12 | 1365 | 1581 | 99.00 | 20 | present | present | present | present | not present |
| Comparative example 4 | 1293 | 1590 | 52.33 | 0 | present | present | present | present | present |
| Example 13 | 1380 | 1582 | 98.01 | 40 | present | present | present | present | not present |
| Example 14 | 1366 | 1551 | 99.01 | 30 | present | present | present | present | not present |
| Comparative example 5 | 1266 | 1575 | 22.01 | 0 | present | present | present | not present | present |
| Example 15 | 1345 | 1542 | 96.40 | 30 | present | present | present | not present | not present |
| Comparative example 6 | 1377 | 1493 | 99.31 | 10 | not present | not present | not present | not present | not present |
| Comparative example 7 | 1351 | 1601 | 98.95 | 10 | not present | not present | not present | not present | not present |
| Comparative example 8 | 1344 | 1610 | 99.20 | 10 | not present | not present | not present | not present | not present |
| Comparative example 9 | 1281 | 1592 | 45.57 | 0 | not present | not present | not present | not present | present |
| Comparative example 10 | 1380 | 1727 | 93.92 | 0 | not present | not present | present | not present | not present |
| Comparative example 11 | 1383 | 1704 | 96.91 | 10 | not present | not present | present | present | not present |
| Comparative example 12 | 1325 | 1627 | 83.36 | 0 | not present | not present | present | present | present |
| Comparative example 13 | 1304 | 1562 | 93.83 | 0 | present | present | present | not present | not present |
| Example 16 | 1340 | 1720 | 98.52 | 30 | present | present | present | present | not present |
| Example 17 | 1308 | 1844 | 98.02 | 30 | present | present | present | present | not present |
| Example 18 | 1366 | 1551 | 99.01 | 30 | present | present | present | present | not present |
| Example 19 | 1365 | 1563 | 98.96 | 30 | present | present | present | present | not present |
| Example 20 | 1384 | 1514 | 97.90 | 30 | present | present | present | present | not present |
| Example 21 | 1393 | 1470 | 99.38 | 30 | present | present | present | present | not present |
| Example 22 | 1399 | 1440 | 99.28 | 30 | present | present | present | present | not present |
| Example 23 | 1348 | 1470 | 99.00 | 40 | present | present | present | present | not present |
| Example 24 | 1367 | 1555 | 98.56 | 40 | present | present | present | present | not present |
| Example 25 | 1336 | 1572 | 98.43 | 40 | present | present | present | present | not present |
| Comparative example 14 | 1293 | 1552 | 87.87 | 0 | present | present | present | present | present |
| Example 26 | 1379 | 1555 | 95.68 | 30 | present | present | present | present | not present |
| Example 27 | 1372 | 1567 | 96.02 | 30 | present | present | present | present | not present |
| Example 28 | 1364 | 1583 | 95.66 | 30 | present | present | present | present | not present |

TABLE 2-continued

| | Br (mT) | Hcj (kA/m) | Hk/Hcj (%) | Optimum sintering temperature range (° C.) | Presence of each phase: Zr-B phase grain bounadry | Zr-B phase inside of main phase grains | Zr-C phase grain bounadry | Zr-C phase inside of main phase grains | R2-T17 phase |
|---|---|---|---|---|---|---|---|---|---|
| Example 29 | 1352 | 1594 | 95.49 | 30 | present | present | present | present | not present |
| Example 30 | 1349 | 1519 | 95.04 | 30 | present | present | present | present | not present |
| Example 31 | 1350 | 1437 | 95.30 | 30 | present | present | present | present | not present |

NUMERICAL REFERENCES

1 . . . Demagnetization curve
2 . . . Outer region (of demagnetization curve)
3 . . . Inner region (of demagnetization curve)
11 . . . $R_2T_{14}B$ phase
12 . . . R—O—C—N phase
13 . . . Zr—B phase
14 . . . Zr—C phase
15 . . . $R_6T_{13}Ga$ phase
16 . . . R-rich phase
21 . . . Ti—B phase
22 . . . Ti—C phase

The invention claimed is:

1. An R-T-B based permanent magnet comprising C, O, and M, wherein

R is a rare earth element, T is Fe or a combination of Fe and Co, B is boron,

M includes at least Ga and Zr, and further includes at least one element selected from Al, Si, P, Ti, Cr, Mn, Ni, Cu, Zn, Ge, Nb, Ag, In, Sn, Sb, Hf, Ta, W, and Bi, R content is 29.0 mass % to 33.0 mass %, B content is 0.93 mass % to 1.05 mass %, Ga content is 0.30 mass % to 0.79 mass %, O content is 0.03 mass % to 0.20 mass %, C content is 0.03 mass % to 0.30 mass %, at least one of Dy, Tb, and Ho is optionally included as R, and a total content of Dy, Tb, and Ho is 0 mass % or more and 1.0 mass % or less, where the R-T-B based permanent magnet is 100 mass %, and the R-T-B based permanent magnet satisfies the following (1'):

$$3.48m(B)-2.67 \leq m(Zr) \leq 3.48m(B)-2.07 \quad (1')$$

in which m(B) (mass %) is B content and m(Zr) (mass %) is Zr content, and a Hk/Hcj is 95.49% or more and 99.38% or less, a residual magnetic flux density Br at 23° C. is 1305 mT or more, and a coercive force Hcj is 1432 kA/m or more.

2. The R-T-B based permanent magnet according to claim 1, wherein a total area ratio of $R_2T_{17}$ phases is 0.5% or less.

3. The R-T-B based permanent magnet according to claim 1, wherein the B content is 1.00 mass % to 1.05 mass %.

4. The R-T-B based permanent magnet according to claim 1, wherein Co content is 0 mass % or more and 3.0 mass % or less.

5. The R-T-B based permanent magnet according to claim 1, wherein Cu content is 0.1 mass % or more and 0.6 mass % or less.

6. The R-T-B based permanent magnet according to claim 1, wherein Al content is 0.07 mass % or more and 1.0 mass % or less.

7. The R-T-B based permanent magnet according to claim 1, wherein the R-T-B based permanent magnet further includes N, and N content is 0.03 mass % or more and 0.20 mass % or less.

8. The R-T-B based permanent magnet according to claim 1, wherein the total content of Dy, Tb, and Ho is 0 mass % or more and 0.5 mass % or less.

9. The R-T-B based permanent magnet according to claim 1, wherein the total content of Dy, Tb, and Ho is 0 mass % or more and 0.1 mass % or less.

10. The R-T-B based permanent magnet according to claim 1 satisfying $0.0979m(Zr)-0.44m(B)+0.39 \leq m(C) \leq 0.0979m(Zr)-0.44m(B)+0.49$ in which m(C) (mass %) is C content.

11. The R-T-B based permanent magnet according to claim 1 further including a Zr—B phase, a Zr—C phase, and an $R_6T_{13}Ga$ phase.

12. The R-T-B based permanent magnet according to claim 10, wherein a total area ratio of $R_2T_{17}$ phases is 0.5% or less.

13. The R-T-B based permanent magnet according to claim 11 further including an R—O—C—N phase.

14. The R-T-B based permanent magnet according to claim 11, wherein a total area ratio of $R_2T_{17}$ phases is 0.5% or less.

15. The R-T-B based permanent magnet according to claim 11, wherein a long side of the Zr—B phase is 300 nm or more and 500 nm or less in average.

16. The R-T-B based permanent magnet according to claim 10 further including a Zr—B phase, a Zr—C phase, and an $R_6T_{13}Ga$ phase.

17. The R-T-B based permanent magnet according to claim 16 further including an R—O—C—N phase.

18. The R-T-B based permanent magnet according to claim 15 further including an R—O—C—N phase.

19. The R-T-B based permanent magnet according to claim 16, wherein a long side of the Zr—B phase is 300 nm or more and 500 nm or less in average.

20. The R-T-B based permanent magnet according to claim 19 further including an R—O—C—N phase.

* * * * *